United States Patent [19]

Macchi

[11] Patent Number: 4,651,375

[45] Date of Patent: Mar. 24, 1987

[54] LAUNCHING SYSTEM FOR BRIDGE BAYS, ESPECIALLY CONTINUOUS-BEAM BRIDGES MADE UP OF PREFABRICATED SEGMENTS AND TO BE TIGHTENED UPON INSTALLATION BY MEANS OF PRESTRESSED WIRES

[76] Inventor: Romualdo Macchi, Via S.Paolo, 31, 56100 Pisa, Italy

[21] Appl. No.: 796,609

[22] Filed: Nov. 8, 1985

[30] Foreign Application Priority Data

Nov. 15, 1984 [IT] Italy ..... 9540 A/84

[51] Int. Cl.[4] ..... E01D 21/00

[52] U.S. Cl. ..... 14/7; 14/1; 14/13

[58] Field of Search ..... 14/1, 4, 6–8, 14/13, 14, 17–23, 73; 52/223 R, 227; 212/186

[56] References Cited

U.S. PATENT DOCUMENTS

| | | | |
|---|---|---|---|
| 3,299,191 | 1/1967 | Mantscheff et al. | 52/223 R X |
| 3,570,207 | 3/1971 | Launay | 52/227 X |
| 3,707,011 | 12/1972 | Launay | 14/1 |
| 3,902,212 | 9/1975 | Muller | 14/1 |
| 4,352,220 | 10/1982 | Wittfoht | 14/1 |

FOREIGN PATENT DOCUMENTS

| | | | |
|---|---|---|---|
| 53081 | 6/1982 | European Pat. Off. | 14/73 |
| 1214716 | 4/1966 | Fed. Rep. of Germany | 14/18 |
| 1230062 | 12/1966 | Fed. Rep. of Germany | 14/18 |
| 436374 | 6/1948 | Italy | 14/1 |
| 113108 | 5/1968 | Norway | 14/18 |
| 306758 | 12/1968 | Sweden | 14/8 |
| 2011980 | 7/1979 | United Kingdom | 14/1 |
| 947260 | 7/1982 | U.S.S.R. | 14/17 |
| 1084354 | 4/1984 | U.S.S.R. | 14/1 |
| 1101492 | 7/1984 | U.S.S.R. | 14/21 |

*Primary Examiner*—Stephen J. Novosad
*Assistant Examiner*—John F. Letchford
*Attorney, Agent, or Firm*—McGlew and Tuttle

[57] ABSTRACT

The launching apparatus, including a stayed metallic beam, is provided with two poles, one of which rests on the plank in correspondence of the last pier of the already formed bridge and the other rests on a cantilever end of said bridge length, bracket-like projecting beyond said pier; between the two poles connection stays are provided parallel to each other, either horizontal or inclined, whereas inclined stays are anchored at each of the two poles and at the corresponding length of the metallic beam which is external to the pair of poles.

9 Claims, 7 Drawing Figures

LAUNCHING SYSTEM FOR BRIDGE BAYS, ESPECIALLY CONTINUOUS-BEAM BRIDGES MADE UP OF PREFABRICATED SEGMENTS AND TO BE TIGHTENED UPON INSTALLATION BY MEANS OF PRESTRESSED WIRES

FIELD AND BACKGROUND OF THE INVENTION

In these last years the most wide spread technology for the construction of bridges made up of reinforced prestressed concrete is the technology that utilizes prefabricated segments or quoins to make up the bridge. This technology consists essentially in the prefabrication of the bridge segments, some meters long, which are installed in succession side-by-side on special supporting and launching means. Prestressed wires are then inserted and stretched to engage the quoins solidly against each other and thus render the pertinent bridge length self-bearing. The support means are then recovered and reutilized. These means are constituted of metallic carpentry and also provided with stays.

This technology is now receiving a new impulse from the use of prestressed wires disposed outwardly of the concrete section of the segments or quoins.

Among the means used to sustain the segments or quoins prior to the prestressing operation, only two systems are particularly interesting: The first utilizes a metallic beam with stayed wires for supporting the segments close to each other prior to the prestressing in order to form a bay; and the second utilizes a temporary stay for each segment or quoin until a complete beam is made up and, after the prestressing of the plank, the temporary stays are removed and the procedure is repeated. A feature that is common to the two systems is the use of a metallic pole from which two sets of stays branch off, one being oriented towards the piers to be reached by the new bay under formation, the other towards the pier already surpassed and anchored thereto for the necessary balancing of the forces arising from the stays which support the bay under construction.

Referring to the first system, it is useful to point out that if the height of the pole is to be kept within acceptable limits of economy and practicality—especially during the self-launching of the apparatus from one bay to the other—the minimum inclination of the stays must be about 25°, since a lesser inclination would cause a greater force in the stays and a greater horizontal thrust in the metallic beam from which the prefabricated segments or quoins hang.

The vertical reaction on the pole is approximately twice as much the weight borne by the metallic beam, the stays inclination towards the pier to be reached being substantially equal to that of the stays making up the anchorage towards the pier already surpassed, and the reactions of both the opposite sets of stays being discharged onto the pole.

These considerations—which are valid also for the above mentioned second system—limit the field of application of the two systems to spans of about 50 meters, and also require to oversize supporting apparatuses for the bridge since, in general, the ratio between the steady loads and the overloads is greater than 1.

SUMMARY OF THE INVENTION

The system according to the invention overcomes the above limitations and permits the construction of every type of bridge, also and especially of continuous beam type, with spans over 100 meters, with whatever ratio between the steady loads and the mobile loads and with any value of the cantilever length under construction. This is done by keeping the height of the poles, as well as the cross section of the two segmented-holding beams that are side-by-side, within acceptable limits of economy and practicality and so as to never generate in the continuous beam under construction, greater stresses than the maximum stresses for which the beam itself has been dimensioned for its final duty.

In order to achieve the above purposes, the invention provides a launching system for the formation of bridges with the use of segments or quoins to be associated with each other upon the installation, that uses prestressed wires forming, with said segments, a beam, especially a continuous beam.

According to the invention two poles are employed, one of which rests approximately on the last pier of the bridge length already formed and the other rests near a cantilever end of said bridge length projecting like a bracket beyond said pier. Between the two poles connection stays are provided, while inclined stays extend outwardly of the two poles. This arrangement is usable in both of the above mentioned systems. That is, the system with temporary stays anchored to the quoins or segments and the system with the metallic launching beam. In this system with the metallic beam, the inclined stays are anchored to the two poles and to the metallic beam of the apparatus, for the launching of the quoins or segments. The quoins or segments are launched at opposite sides of the pair of poles.

The connection stays between the two poles are disposed either horizontally or in an inclined position in order to change at will the load on the pole that is needed for the cantilever length.

Advantageously, for isostatic condition requirements, the poles are hinged to the respective supports.

The lengths of metallic beams which are upstream (on one side) of the poles, between the poles, and downstream (on the opposite side) of the poles, may be articulated to each other by means of hinges which, besides assuring that an isostatic system results, facilitate as well the launching of curved bridges without excessive difficulties.

According to another characteristic aspect of the invention—particularly when used with a stayed metallic beam—at the end of the launching metallic beam, an extension structure is articulated. This structure is capable of being lowered and is caused to rest on the pier which is to be reached by the bay under formation. Such an extension structure is advantageously developed with an intermediate support—especially with a central support—in order to form also therewith a cantilever length bracket beyond the pier. This support is obtained by the presence of a special segment or quoin which can slide onto the pier relative to the extension structure.

Practically, the extension structure may have a temporary side support to accommodate a particular support segment or quoin on the pier to be reached and surpassed by the bay under formation. This particular segment or quoin is able to slide relative to the pier and the supporting foot of the extension structure upon the stretching of the prestressed wires.

The extension structure may include a pole corresponding to the support on the pier and stay wires developing at opposite sides of the pole so as to realize a relatively very light structure.

BRIEF DESCRIPTION OF THE DRAWINGS

The drawings show schematically show a non-limiting example of the invention.

DESCRIPTION OF THE PREFERRED EMBODIMENT

Figure 1:
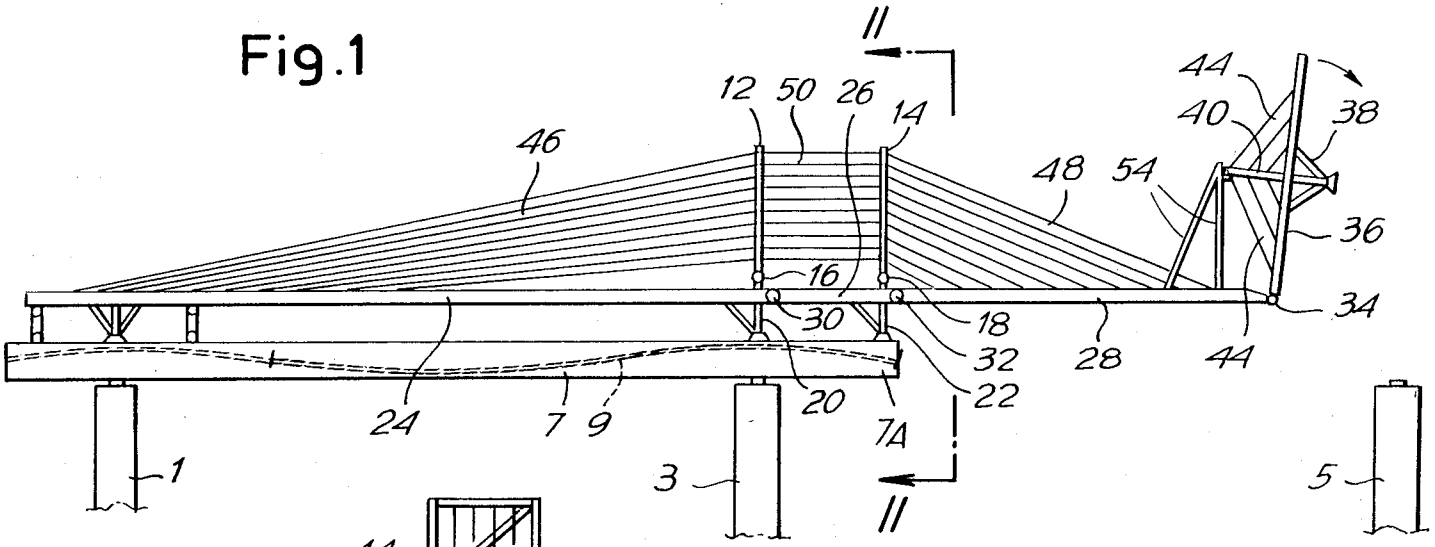
FIG. 1 is a side view of the apparatus prior to the beginning of the launching operation.
Figure 2:
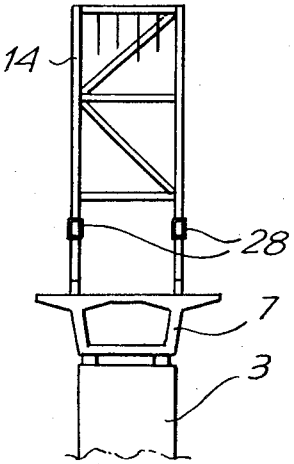
FIG. 2 is a sectional schematic front view on line II—II of FIG. 1.
Figure 3:
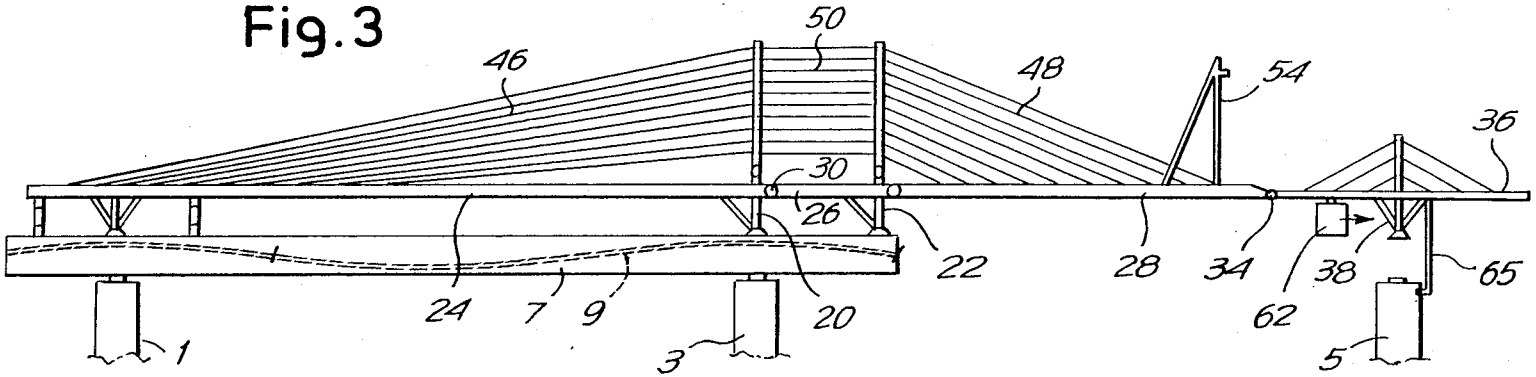
FIGS. 3 to 7 show, similarly to FIG. 1, various steps of the launching operation.

With reference to the drawings which show the construction steps of a bay of a continuous beam with spans of 100 m or more, numerals 1, 3, 5 indicate support piers, and numeral 7 indicates a bay already formed and being sustained by piers 1 and 3. This bay has a part 7A which projects in cantilever fashion (see FIG. 1) toward the pier 5 on which the subsequent bay to be formed is intended to rest. The bay or beam 7, 7A is a portion of a continuous beam that is reinforced by prestressed wires 9 having the typical development imposed by the moments variation between piers. At the end of the cantilever length 7A the moment is zero.

The launching apparatus for the arrangement of the subsequent segments or quoins 10 comprises two poles 12 and 14 articulated at 16 and 18 to supports 20 and 22 which rest on the beam 7, 7A, in correspondence with the pier 3 and at the end of bracket or cantilever length 7A respectively. Pairs of sections of side by side metallic beams 24, 26, 28, hinged one after the other at 30 and 32, carry the rails for the slide of segments or quoins 10. The section 26 extends approximately between the supports 20 and 22, and the section 28 extends along a portion of the bay to be formed between the piers 3 and 5 beyond the cantilever length 7A. At the end of section 28, a further pair of beam sections 36 with a central support 38 and a pole 40 is articulated at 34.

Figure 7:
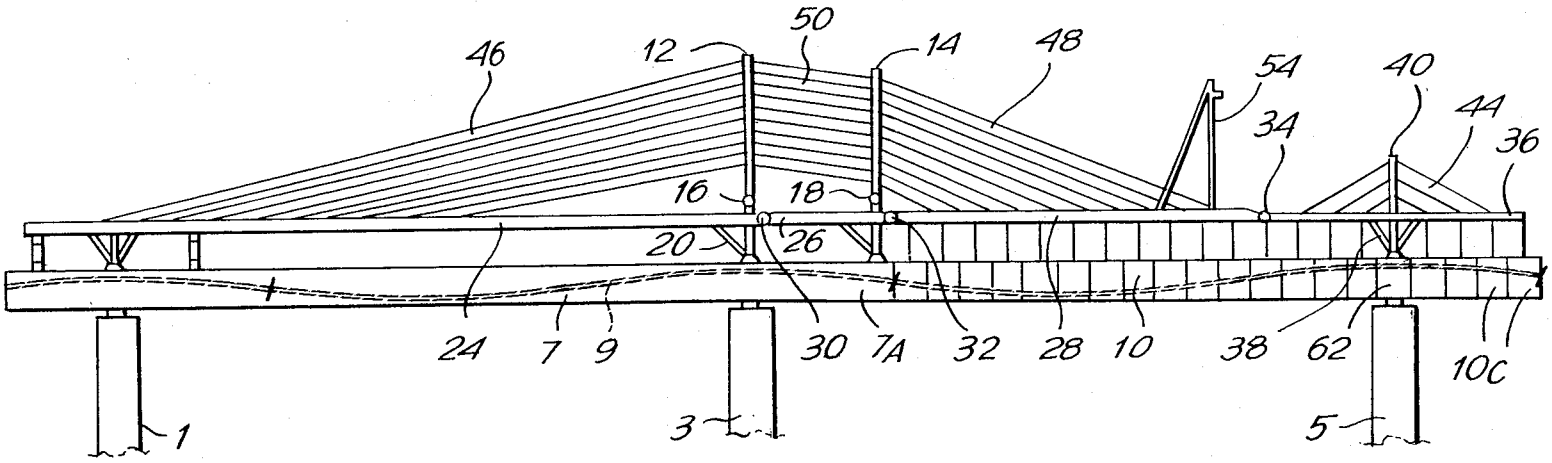

Two sets of stays 44 are provided between the beam 36 and the pole 40. Between the pole 12 and the beam section 24, stays 46 are provided. Between the pole 14 and the beam 28, stays 48 are provided. Between the two poles 12 and 14, stays 50 are provided. These stays 50 may be disposed either horizontally (FIGS. 1 and 2 to 6) or inclined (FIG. 7) for the purposes indicated below.

Numeral 62 indicates (FIGS. 3 to 7) a segment or quoin intended to rest on the pier 5, and numeral 10 indicates the quoins or segments intended to form the bay between the cantilever length 7A and the pier 3 and beyond it. The quoins or segments are made to slide under the beams 26, 28 and 36. Quoins or segments are also made to slide under beam 36 in order to make up a bracket-like length which projects from pier 5 in cantilever fashion. This bracket-like length is similar to the one indicated by 7A. The individual quoins or segments are lowered—after their slide—in alignment with the quoins previously predisposed and brought close therewith so as to receive the action of the prestressed wires.

Figure 4:
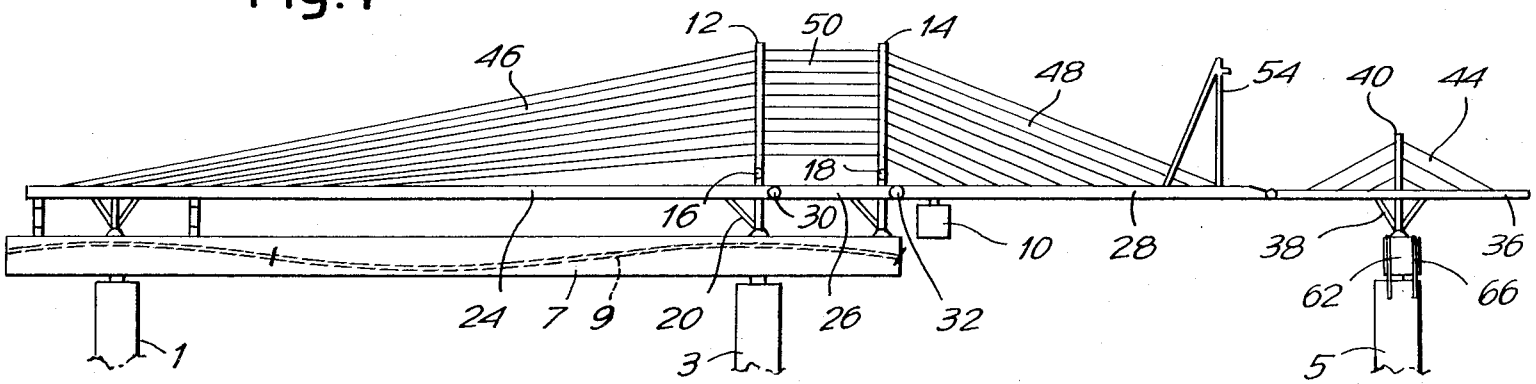

The metallic apparatus is initially arranged as shown in FIG. 1, with the beams 36 almost vertical and being retained by trestles 54. The apparatus 36, 38, 40 is then lowered on the pier 5, and made to rest temporarily thereon through props 65 (FIG. 3) for the transfer of the quoin 62. This is made to rest on pier 5 (FIG. 4) through sliding supports, and the support 38 is left to act upon said quoin 62 through other sliding supports. Temporary tension rods 66 stabilize this arrangement (FIG. 4).

Figure 5:
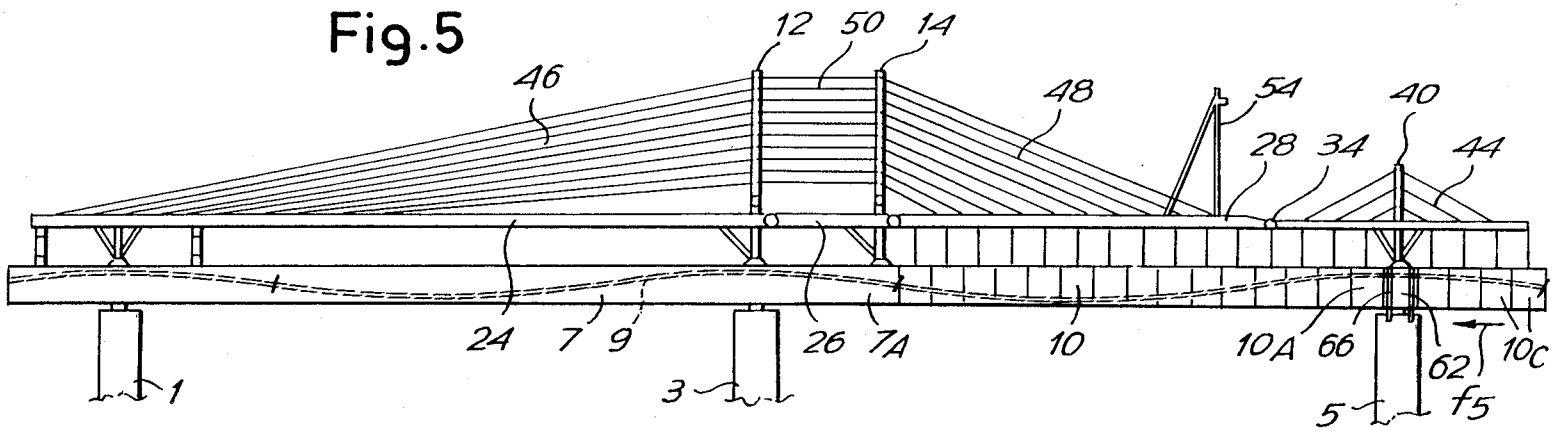
Figure 6:
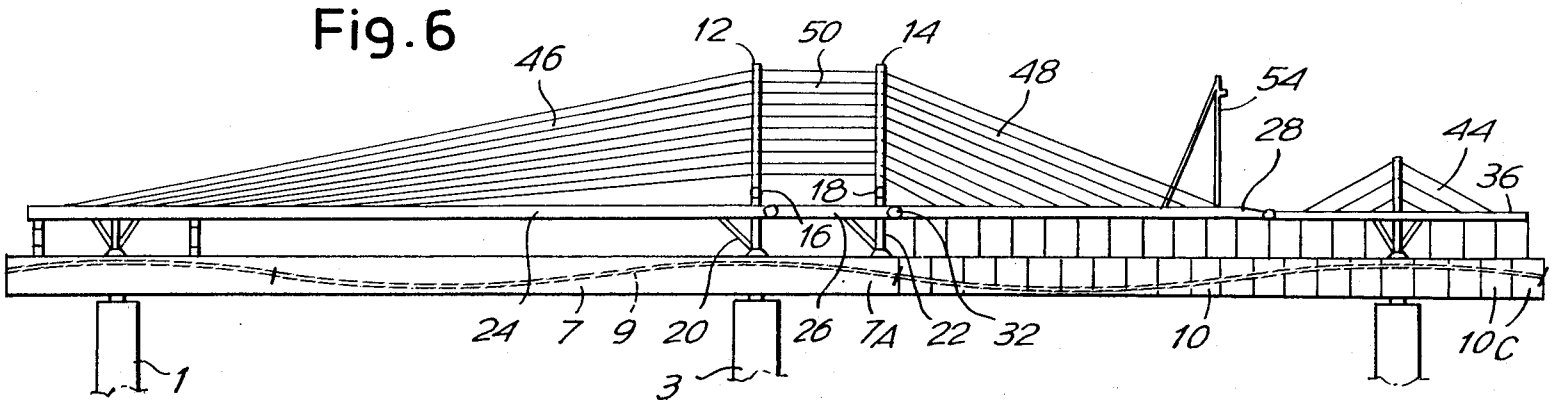

The novel solution is characterized essentially by the use of the two poles 12 and 14, the first (12) resting on the bay or plank in correspondence with the pier 3, the second (14) resting in correspondence with the cantilever end 7A. The two poles 12 and 14 are interconnected by the set of parallel stays 50 which may be horizontal or may have some inclination. The parallel metallic beams 24, 26, 28 which bear the prefabricated segments 10 and 62 hanging therefrom are interrupted by the hinge 32 in correspondence with the last stay 48 coming from the pole 14, and continue with the lengths 36, having reduced cross section and being astride the pier 5. These beams are sustained by the two sets of stays 44 connected to the auxiliary smaller pole 40 which rests directly on the prefabricated segment 62, the latter being made temporarily solid with the pier 5 by means of vertical wires 66 (FIGS. 4, 5). The two poles 12 and 14 are firmly anchored to the preceding pier 1 by means of the set of stays 46. By performing simple resolutions of forces it may be seen that the weight of the prefabricated segments 10—which hang, at the end with the operation, in correspondence of the beam length 36—acts entirely upon the pole 40 and, therefore, through the quoin 62 and the temporary support apparatuses, on the pier 5, whereas the weight of the prefabricated segments hanging from the beam length 28 act entirely upon the pole 14, if the connection stays 50 between the poles 12 and 14 are kept parallel and horizontal. If the value of the vertical force on the pole 14 is to be changed to meet any structural or design requirement—in order, for example, not to jeopardize, under critical bending conditions, the section of the bridge supported on the pier 3 that, for obvious economy reasons, must be dimensioned only for the maximum moments derived from its ultimate functioning as a continuous beam—it is sufficient to create a difference of level between the poles 12 and 14 (FIG. 7) so that the connecting stays 50 are inclined at a certain angle to the horizontal. If it is desired, for example, that the vertical force on the pole 14 be decreased, then the pole 12 must be raised and prolonged to some extent above the hinge 16, so that the parallel connection wires 50 between the poles 12 and 14 become inclined to the horizontal by a certain angle upwardly and toward the pole 12 (FIG. 7), thus determining an upward vertical component that will relieve the vertical force on the pole 14 to the desired amount, while increasing the force on the pole 12.

It is interesting to note that the metallic bearing structure of this novel launching system is extremely isostatic and therefore unaffected by relative yieldings like, for example, the elastic yieldings which occur during the positioning of the quoins between the pole 12, which is practically fixed, and the pole 14 resting on the cantilever length.

The above description evidences the importance to be ascribed to the use of the two poles 12 and 14, which permit the accurate calculation of the vertical force on the cantilever length 7A of the continuous beam 7 under construction. This force creates a negative moment on the support 3 of such a value as to obtain, in the portion of the continuous beam 7, 7A already built, the exact distribution of bending moments—negative and positive—as would occur if the whole continuous beam had been constructed at one time. In particular, the barycenter of the section at the end of the cantilever length 7A will lay on the geometrical axis of the beam in its final configuration, and the section will be at right angles thereto. A perfect matching will thus be possible between the end section of the cantilever length 7A of the beam 7 already completed and the fresh segments 10 so as to trace with accuracy the line of the final axis of the bridge.

Moreover, the presence of the negative moment at the support 3 makes possible the transit on the beam 7 of the slides or carriages carrying the individual prefabricated segments which will be fed to complete the beam between the piers 3 and 5 and the cantilever length beyond the pier 5, even without utilizing the beams 24,26. By using one pole only in correspondence with the pier 3—as is provided in the prior art—the distribution of the bending moments in the bay between piers 1 and 3 are—owing to the predominance of the positive bending moments due to the lack of negative moment on support 3—quite different from that occurring in the continuous beam and, therefore, the section at the end of the cantilever length 7A undergoes a relevant lift and a rotation that is incompatible with the continuity of the axis line of the bridge and makes the matching between the part already fabricated and the one to be assembled with the quoins 10 practically impossible. The transit of the quoins on the bay between piers 1 and 3 would also be impossible unless overdimensional structure are used.

The use of the two poles 12 and 14 has also the advantage that, with the pole 14 placed on the cantilever length 7A which is in general about 20% of the span between the piers 3 and 5, a first reduction is obtained of the stresses in the main launching structure. A second reduction on the stresses of the same order is then obtained by the use of the third auxiliary pole 40 which—as results from simple geometrical considerations—supports the weight of the prefabricated segments along a stretch equal to 20% of the span, on the left side of pier 5, and along a stretch of equal length on the right side of same pier 5. In the final analysis, by taking into account the two poles 12 and 14 and the third pole 40, the main stayed beam 28 of the launching apparatus may be dimensioned for stresses corresponding to 60% of the span between the piers of the continuous beam to be constructed, with remarkable economical and practical advantages.

It should be also noted that the pole 40 which sustains directly 40% of the weight of segments 10, acts directly upon the upper part of a prefabricated segment 62, the first one being installed (see FIG. 4), and that such segment may be made to slide longitudinally, by means of upper and lower temporary apparatuses made of Teflon (a trade name), both relative to pier 3 and relative to the bearing foot 38 of the pole 40.

Once the location of segments or quoins 10 has been completed, the resulting arrangement is the one shown in FIG. 5. Between the segment 62 and the last segment 10A of those disposed between the cantilever length 7A and the same segment 62, a space of a few centimeters necessarily remains. When the longitudinal prestressed wires are stretched, the prefabricated segment 62 and the segments 10C to the right of pier 5 and connected thereto, slide lengthwise according to arrow f5 relative to the pier 5 and the bearing foot of the pole 40 which remains in its initial position. This sliding motion annuls the above mentioned space.

The particular arrangement of the pole 40 avoids costly and complicated transverse metallic structures projecting cantilever fashion from pier 5, which would be necessary in case the pole had to be connected directly with to the pier 5.

In the construction of curved continuous beams, even those with a relatively small radius of curvature, the illustrated procedure based on the use of three poles 12, 14, 40 which subdivide the stayed bearing beams 24, 26, 28 into three parts, allows an easy fitting of the launching apparatuses along the curved trajectory of the bridge axis. The arrangement of the two hinges 30, 32 permits disposition of the beams 24, 26, 28 according to the broken line which approximates the curved profile of the bridge to be constructed.

It is understood that the drawings show one exemplification given only as a practical demonstration of the invention, as this invention may vary in its form and disposition without departing from the principles forming the basis of the invention.

I claim:

1. A launching apparatus for constructing a bridge having a plurality of spaced-apart piers and a completed beam length (7) spanning at least two piers, the beam length having a cantilever length (7A) extending in cantilever fashion beyond one of the piers (3), the beam length being made of prefabricated segments which are connected to each other by prestressed wires, the launching apparatus comprising, a first substantially vertical pole (12) supported on the one pier (3) from which the cantilever length extends, a second substantially vertical pole supported on said cantilever length near an end thereof spaced from said first pole, a plurality of parallel connection stays (50) connected between said first and second poles, at least one metallic beam (24, 26, 28) extending along the beam length, a first set of inclined stays connected between said first pole and said metallic beam in an area of said metallic beam between the two piers spanned by the beam length, and a second set of inclined stays connected between said second pole and said metallic beam on a portion of said metallic beam extending beyond the cantilever length.

2. A launching apparatus according to claim 1, wherein said connection stays are substantially horizontal.

3. A launching apparatus according to claim 1, wherein said connection stays are inclined with respect to the horizontal.

4. A launching apparatus according to claim 1, including a first support connected between the beam length and said first pole which is supported by the one pier, a second support connected between the cantilever length and said second pole, a first hinge connection connected between said first support and said first pole and a second hinge connection connected between said second support and said second pole whereby said first and second poles are pivotally mounted to said first and second supports respectively.

5. A launching system according to claim 1, wherein said metallic beam comprises a first portion substantially extending over the beam length between the two piers, a second portion substantially extending between said first and second poles and a third portion extending beyond the cantilever length, said first and second portions being pivotally mounted to each other at a hinge and said second and third portions being pivotally mounted to each other at a hinge whereby curved beam lengths can be constructed.

6. A launching apparatus according to claim 1, including a metallic beam extension (36) pivotally mounted to an end of said metallic beam spaced away from the two piers spanned by the beam length, said metallic beam extension having a length sufficient to extend over a subsequent pier spaced from the two piers spanned by the beam length when the metallic beam extension is in a horizontal position.

7. A launching apparatus according to claim 6, including a third support connected near a middle of said metallic beam extension, said third support extending downwardly from said metallic beam extension for support on the subsequent pier whereby said metallic beam extension is supported in cantilever fashion on the subsequent pier.

8. A launching apparatus according to claim 7, including a temporary prop connected to and extending downwardly from said metallic beam extension when said metallic beam extension is in a substantially horizontal position for engaging the subsequent pier to support said metallic beam extension, said third support being engageable on a prefabricated segment which is engaged upon the subsequent pier.

9. A launching apparatus according to claim 8, including a third pole connected to and extending upwardly from said metallic beam extension near the center of said metallic beam extension and over said third support, and a plurality of stay wires connected between said third pole and said metallic beam extension on both sides of said third pole.

* * * * *